US008365864B1

(12) United States Patent
Sherer

(10) Patent No.: US 8,365,864 B1
(45) Date of Patent: Feb. 5, 2013

(54) WELDERS SEAT FOR IRON WORKERS

(76) Inventor: Robert P. Sherer, Bethlehem, PA (US)

( * ) Notice: Subject to any disclaimer, the term of this patent is extended or adjusted under 35 U.S.C. 154(b) by 883 days.

(21) Appl. No.: 11/434,851

(22) Filed: May 16, 2006

(51) Int. Cl.
*E04G 5/00* (2006.01)

(52) U.S. Cl. ..... 182/150

(58) Field of Classification Search ..... 182/45, 182/150, 206; 472/110; 248/228.6; 297/217.7, 297/423.26
See application file for complete search history.

(56) References Cited

U.S. PATENT DOCUMENTS

| | | | | | |
|---|---|---|---|---|---|
| 82,992 | A | * | 10/1868 | Rich | 297/195.11 |
| 127,314 | A | * | 5/1872 | Darley | 182/20 |
| 274,334 | A | * | 3/1883 | Hurley | 182/57 |
| 1,312,399 | A | | 8/1919 | Heywood | |
| 1,380,893 | A | * | 6/1921 | Gebert | 280/222 |
| 1,422,617 | A | * | 7/1922 | Phelps | 400/219.2 |
| 1,533,261 | A | * | 4/1925 | Pattison et al. | 472/110 |
| 1,895,571 | A | | 1/1933 | Hein | |
| 2,303,954 | A | | 12/1942 | Rake | |
| 2,490,923 | A | | 12/1949 | Sasgen | |
| 2,854,292 | A | | 9/1958 | Schaeffer | |
| 3,011,587 | A | | 12/1961 | Mallog | |
| 3,137,487 | A | | 6/1964 | Lesser | |
| 3,183,997 | A | | 5/1965 | Kleiss | |
| 3,217,833 | A | | 11/1965 | Smith | |
| 3,336,642 | A | | 8/1967 | Armacost | |
| 3,731,762 | A | | 5/1973 | Sirls | |
| 4,171,032 | A | | 10/1979 | Woolslayer et al. | |
| 4,271,927 | A | | 6/1981 | Brown et al. | |
| 4,368,801 | A | | 1/1983 | Lewis | |
| 4,424,760 | A | | 1/1984 | Grufman | |
| 4,570,749 | A | * | 2/1986 | McKibbin | 182/36 |
| 4,928,789 | A | | 5/1990 | Claeys | |
| 5,048,640 | A | | 9/1991 | McConville et al. | |
| 5,165,499 | A | | 11/1992 | Bell | |
| 5,607,029 | A | | 3/1997 | Beckham | |
| 5,730,245 | A | | 3/1998 | Conway | |
| 6,053,279 | A | | 4/2000 | McKenna | |
| 6,227,330 | B1 | | 5/2001 | Preusser et al. | |
| 6,302,238 | B1 | | 10/2001 | Preusser et al. | |
| 2005/0189456 | A1 | * | 9/2005 | Hoffmann | 248/228.1 |

* cited by examiner

*Primary Examiner* — Alvin Chin Shue
(74) *Attorney, Agent, or Firm* — Charles A. Wilkinson; Clinton H. Wilkinson

(57) ABSTRACT

A seat for high erection workers working on large horizontal I-beams is formed with a seat for a worker and particularly a welder at one end of a leverage arm and a friction plate at the opposite end with a clamping point provided by a clamp the ends of which are positioned near one end and on either side of the friction plate and providing a fulcrum point near the end of the leverage arm for urging the friction plate into secure contact with the underside of a flange of a horizontal I-beam. The seat is constructed of light metals and preferably is provided with a lanyard which doubles as a safety tie during use and a carrying strap by which the high-rise working seat may be transported.

12 Claims, 3 Drawing Sheets

WELDERS SEAT FOR IRON WORKERS

BACKGROUND OF THE INVENTION

1. Field of the Invention

The present invention relates generally to construction of buildings and particularly of fairly high and large buildings in which a structural beam framework is initially constructed and other parts are later added and particularly still to construction of such structure from so-called I-beams bolted or welded together and even more particularly to an iron worker's seat or welder's seat which is compact and light enough to be easily transported by a worker and conveniently and easily attached to a horizontal I-beam at or near the bottom of such beam to allow a worker and particularly a welder convenient access to the lower portions of such beam or adjoining or adjacent structures for welding or the like.

2. Preliminary Discussion

In the construction of large buildings, a steel framework formed of structural beams is conventionally erected initially, after which other parts of the building are either attached to or erected around the steel framework. During such construction the construction workers require access to and support on the steel beams including vertical and horizontal I-beams. I-beams are comprised of so-called flanges on the top and bottom connected by an intermediate web between and connecting such flanges. I-beams are very rigid and strong in transverse directions compared with the individual rigidity and strength of their web and flanges as well as with such I-beams overall weight, depending upon the width of both the flanges and central web from which the I-beam is formed. This is because in order to bend the beam in a direction aligned with or parallel to the interconnecting web such as, for example, in a horizontal beam, one entire flange is placed in tension and the other flange in compression with the intermediate web being placed from top to bottom first in tension and then in compression. Furthermore, the beam is also quite stiff or rigid with respect to side forces because such forces are opposed by the width of the beam or, more particularly, one half of the width of the flanges will be placed in tension and the other half essentially in compression with the strength of the flanges in effect being multiplied by two. Such beams can be either produced by a rolling operation in which hot metal in the plastic range is passed through rotating rolls arranged in an H configuration, or, alternatively, can be fabricated from relatively flat structural or heavy sheet or plate sections by welding such sections together in an H configuration. In prior years the best and strongest beams were made from rolled steel sections, but with the demise of heavy rolling mills in the United States due to the widely fluctuating market for such large beams for extremely large buildings or large bridges, both of which are constructed at fairly irregular intervals, most such large I-beams are currently fabricated from sections of flat plate of various thicknesses cut to length and welded together into an H-section, thus saving long distance transportation of large unwieldy beam sections.

I-beams, whether rolled or fabricated, may be either bolted together to form the structure being erected on the job site or more frequently in modern times may be welded together into a building framework. In such welding the welder requires access to the ends or sides of the beam to effect the weld. Access to the sides of vertically erected construction beams is had by hoists or sling seats slung from cranes or derricks or by various climbing aids invented in the past similar to what is used by electric line construction and repairmen and to the upper section or surface of horizontal beams by merely walking on them and sitting or kneeling on them. Thus, access is no great problem with respect to the upper portion of a horizontal beam such as the upper flange, but in a large horizontal beam, such as an I-beam, access to the lower portion of the beam may be difficult unless some sort of scaffold is erected. A welder in particular may require access to the lower flange or the intermediate web by some means other than scaffolding or a sling supported by a crane. Sometimes the welder may lie on the top of the beam and try to reach the web or top of the lower flange with his or her welding torch, but particularly in the case of a large beam, this may be essentially impossible. For this reason a cable may be erected running along the beam and the welder may stand on such cable while working low on the beam or work from scaffolding, which is difficult, or impossible, or at least impractical, except in more elevated positions, or the welder may work from a sling lowered from the top of the beam or otherwise. Yet welding is frequently also necessary on the intermediate sections of large I-beams in order to secure flanges to the main beam for attachment of smaller cross beams, as well as for securing such smaller cross beams to the flanges.

The present inventor has designed a simple but sturdy seat which may be clamped securely usually to the lower portion or flange of a beam, upon which seat a welder can sit with the lower portion and particularly the sides of the intermediate web and top of the lower flange of the beam readily accessible. The seat is basically cantilevered out from the lower flange with the feet of the welder placed on a short footrest for balance, comfort and safety. A safety lanyard may be hooked to or attached from the seat to the usual safety line required by law to be present and run usually lengthwise of the beam to provide a place for the worker to secure or tie off his or her safety line attached to the usual safety belt worn by the worker. Tying off or securing the safety lanyard attached to the seat itself secures the seat in case it should become displaced or dislodged and prevents its fall to lower areas or to the ground with possible serious injury or death to anyone below.

The usual safety tie off line extends along the length of a horizontal beam between the upper and lower flange, which safety cables or securing lines are required by federal law on all high beam structures for welders and other high workers to tie off to, or secure their safety lines to. Thus, if either the welder or the seat of the invention should fall from their position, neither the welder nor the seat will continue on to the ground with damage to underlying personnel or equipment not to mention the welder him or herself. The seat of the invention, being fairly lightweight, can also be carried by a welder or other worker between actual uses slung from the worker's shoulder like a piece of luggage by means of the seat safety line snap attached to the end of the seat.

The seat of the invention comprises an aluminum or aluminum alloy tube or H-section with a flat beam engaging structural section attached or welded to one side at the top of one end and a crosswise seat section welded or otherwise attached to the top at the other end. A wrought steel clamp section, preferably in the form of a C-type-clamp, which is attached to the bottom of the tube section near the inner end of the flat beam engaging sections in a position such that a threaded rotating adjustment member mounted in the upper end of the C-clamp when threaded into its lowest position will contact the top of the flat beam engaging section, or, if one flange of an I-beam is interposed between the two will contact the top of the I-beam flange securely clamping the end of the seat beam to the I-beam flange. The welder may then sit on the seat section at the other end of the seat beam with his or her feet supported upon a short cross-piece at the bottom of a support tube or other structural member depending downwardly from the cross beam upon which the seat member and clamp member are mounted. The footrest section may be pivoted so it can be folded for carrying and the safety strap can, as indicated above, be used as a sling for carrying the seat conveniently over the welder's shoulder or across his back as well as being used to "tie off" or secure the safety seat during use. The provision of a wide flat lower portion or seat for the threaded clamp section allows the safety seat to be securely clamped to an I-beam flange whether such beam is a rolled beam or a fabricated beam and the threaded member preferably has a conventional universally pivoting relatively small diameter end clamp positioned on the end of the threaded member to adjust conventionally to any small angle or top angle of the flange of either a rolled H-beam or a flat flange fabricated H-beam structure. The cantilevered structure with the weight of the welder exerted on the outer end driving or pressing the outer end of the flat friction plate into the bottom of the I-beam with the rotational movement being about the leverage point represented by the point of tightening of the clamp on the upper surface of the I-beam flange provides a very secure attachment. The leverage of the outer end of the friction plate prevents any possible slippage of the seat from the flange even if the clamp has not been securely tightened as long as the clamp is secure enough to form an effective pivot point, although it is, of course, advisable to securely tighten the clamp as well.

3. Discussion of Prior Art

There have been a fair number of inventions directed to use by iron-workers for access to work surfaces during the use of I-beams for building structures, including buildings and bridges, to provide a location or structure from which to safely and conveniently do any necessary work while supported by the framework and usually from the flanges of I-beams. Many of such references deal with clamps of one sort or another for securing a hold on the flanges of either vertical or horizontal I-beams as set forth in the following references.

U.S. Pat. No. 1,312,399 issued to H. H. Heywood, Dec'd, on Aug. 5, 1919, entitled "Device for Climbing Steel Columns," discloses an apparatus which is strapped to an iron worker's boots or shoes and aids such worker in climbing up and down a structural steel I-beam. A flat plate portion (5) is integrally connected to a laterally directed U-shaped clamp or yoke (6), and a pair of ears (7) are situated at the connection point of the plate (5) and yoke (6). A set screw (10) having a lock nut (11) thereon extends inwardly through arm (9) of U-shaped yoke (6) towards plate portion (5). Similar set screws (12) having lock nuts (13) thereon extend inwardly through ears (7), with set screws (12) being lower than set screw (10) as shown in FIG. 1. In use, as also shown in FIG. 1, the worker secures his feet on plate (5) with straps (14). The device is then adjusted so that the flanges (B) of the I-beam (A) are between the set screws (10 and 12). When the user presses downwardly on plate (5), set screws (12) engage flange (B) and the plate essentially acts as a step for the worker. Heywood generally illustrates the use of a C or U clamping member to secure a support surface to a structural steel beam, although obviously it has nothing to do with securing a seat to an I-beam.

U.S. Pat. No. 1,895,571 issued to J. Hein on Jan. 31, 1933, entitled "Structural Iron Work Climber," discloses another climber device to assist workers in climbing structural steel beams. Rather than utilizing set screws as in the Heywood invention, Hein utilizes an eccentrically mounted disk (14) or a toothed gripping member (23) as best shown in FIGS. 6 and 8, respectively.

U.S. Pat. No. 2,303,954 issued to A. I. Roke on Dec. 1, 1942, entitled "Safety Device for Workmen on Steel Structures," discloses a safety rope which is connected to a worker by a harness on one end and which is connected to an I-beam by an anchor (10) on the other end. The anchor is comprised of a bar that fits crosswise across the flange of an I-beam and hooks (23 and 24) which extend inwardly from the ends of the bar so as to fit underneath the I-beam flange. Stabilizing wings (21 and 22) are also provided. Roke generally teaches a safety harness connectable to a steel structure, but the anchor arrangement is different from anything used in the present invention.

U.S. Pat. No. 2,490,923 issued to A. M. Sasgen on Dec. 13, 1949, entitled "Quick Action C-Clamp," discloses a novel C-clamp arrangement having a lever on one end so that the clamp may be more easily tightly secured to a work surface.

U.S. Pat. No. 2,854,292 issued to J. M. Schaeffer on Sep. 30, 1958, entitled "Welding Chair," discloses a welding chair for use in welding structural steel beams. Such chair is comprised of a pair of U-shaped side frames connected together by a crossbar (17). Metallic sleeves (10) are welded to the upper ends of the side frames, with hooks (13) slidingly connected to the sleeves (10). As shown in FIG. 3, hooks (13) are secured over the top flange of an I-beam so that the frame structure hangs down below the I-beam on the side of the beam opposite the hooks. The side frames support a seat portion (20) and a footrest portion (21) similar to your seat, but the Schaeffer chair has more of a scaffold-type structural than the seat of the present invention and secured to a beam through a completely different principle.

U.S. Pat. No. 3,011,587 issued to P. H. Mallog on Dec. 5, 1961, entitled "Supporting Device," discloses a support for a seat for working on steel beams which is comprised of a vertically disposed steel channel or tube (10), a seat or support structure extending outwardly from the channel (10), a footrest bar (26), and a means (12) for securing the structure to the flange of a structural beam. The seat (24) and footrest (26) are connected to channel by sleeve (22) so that the vertical position of the seat and footrest is adjustable. The securing means as shown in FIG. 1 includes a pair of strap members (17) and adjustable extension members (18) which extend across the top of a I-beam flange. A cross strip (20) connects extension members (18), and a C-clamp (30) is used to secure cross strip (20) to the flange. Once connected, the worker then lowers himself into the seat (24). The Mallog support device shown in FIG. 1 is somewhat similar to the present invention in that (1) a C-clamp is used to secure the seat to a structural steel beam, and (2) single steel channels comprise the actual seat and footrest portions of the structure. FIG. 3 illustrates an embodiment wherein the device is arranged so that work can be performed under the beam. Note in FIGS. 2-3 that the seat can be swung radially so that it extends underneath the beam. U-shaped member (33) is bolted around the upper end of steel channel (10), and a plate (34) is situated so that it is over the lower flange. C-clamp (35) is then used to engage both plate (34) and the flange so that the device is secured to the beam. A safety rope and harness is also not provided. The principle by which the seat is secured to the beam as well as the arrangement of the seat overall differs, however, from the present applicant's arrangement.

U.S. Pat. No. 3,137,487 issued to F. Lesser on Jun. 16, 1964, entitled "Safety Belt for Scaffolds," discloses a line connected to a worker by a harness or strap on one end and connected in a cylindrical tube on its other end. The tube is connected to a somewhat unique and rather large C-clamp (60) by an arm (17) and stem (62), and the C-clamp is then secured to one flange of the structural beam. Lesser illustrates the use of a single large C-clamp to secure a worker to a beam albeit via a line rather than a seat structure.

U.S. Pat. No. 3,183,997 issued to H. P. Kleiss on May 18, 1965, entitled "Suspended Working Platform Unit," discloses a platform for use in inspecting, maintaining and the like areas such as the inner walls of closed tank structures. The platform is comprised of a vertical support shaft suspended from a carrying member which is mounted above a tank cover plate and having a platform connected to the lower end of the carrying member. Kleiss illustrates another platform for enabling a worker to work underneath a surface while suspended from such surface.

U.S. Pat. No. 3,217,833 issued to D. W. Smith on Nov. 16, 1965, entitled "Safety Device," discloses a safety line for attachment to an iron worker having cooperative J-shaped jaw members which are fitted and locked over the top flange of an I-beam. A worker is secured via a safety strap connected to an elongated bar which is pivotally connected to the worker and J-shaped jaw member. Smith generally teaches another safety harness connected to a device which is removably connected to an I-beam, although such arrangement is not designed to support a worker while working or welding on the underside of a steel beam.

U.S. Pat. No. 3,336,642 issued to R. H. Armacost on Aug. 22, 1967, entitled "Clamp With Preset Tension," discloses another alternative C-clamp arrangement wherein the pressure applied by the clamp to the surface being held may be easily and precisely regulated.

U.S. Pat. No. 3,731,762 issued to J. M. Sirls on May 8, 1973, entitled "Hunting Chair," discloses a chair comprised of a tubular frame structure and including a simple seat member and footrest. As shown in FIG. 5, the chair is designed to be portable so that it may be carried into the woods and deployed in a suitable hunting position. The seat, however, is not clamped to a tree branch or the like using a C-clamp but rather utilizes an arcuate hanger rod having teeth which is secured over a tree limb. A cable and winch arrangement is also provided to aid the user in elevating the chair to the desired position.

U.S. Pat. No. 4,171,032 issued to H. J. Woolslayer et al. on Oct. 16, 1979, entitled "Safety Support for Safety Belts," discloses a support for attachment to a worker safety harness and lanyard arranged so that the worker may move about a fairly large work area yet the lanyard is suspended so that they worker will not fall a large distance in the event of an accident. A vertical sleeve (3) is connected to a structural beam by hooked bolts (5) which are secured to the sleeve by crossbars (4). A slightly angled long vertical pole (8) is rotatably connected to the sleeve, and the lanyard (16) is connected to the upper end of the pole (8).

U.S. Pat. No. 4,271,927 issued to G. S. Brown et al. on Jun. 9, 1981, entitled "Inspection or Maintenance Cradle," discloses a rolling cradle suspended from an I-beam or overhead track. As shown in FIGS. 1 and 8, three roller assemblies are provided on each end of the structure, which assemblies are selectively temporarily removable from the beam or track to facilitate bypassing various obstructions. Brown et al. generally illustrates a more complex, permanent type work platform than your proposed welding or work seat.

U.S. Pat. No. 4,368,801 issued to D. D. Lewis on Jan. 18, 1983, entitled "Column Climbing Device," discloses another device which is worn on the feet of the climber and includes spaced apart jaws which grip opposite edges of the same flange of a structural steel girder. The Lewis jaws apparently are an improvement over the previous foot attachable climbing devices in that they can be more easily moved out of the way when not in use so that the wearer can walk.

U.S. Pat. No. 4,424,760 issued to F. A. Grufman on Jan. 10, 1984, entitled "Hanging Chair," discloses a chair such as a boatswain's chair having a seat, backrest, and a frame comprised of a continuous hose to which the seat and backrest are connected. The chair is apparently meant to hang from a rope rather than being connected to a rigid surface such as an I-beam.

U.S. Pat. No. 4,928,789 issued to S. C. Claeys on May 29, 1990, entitled "Iron Worker's Seat Protector and Gripping Device," discloses a seat protection and gripping arrangement for aiding a worker in more comfortably and securely straddling a steel beam. First, a flexible sheet preferably made of conveyor belting having a smooth inner surface and textured outer surface is provided. Also provided is a waist strap (see FIG. 1) so that the sheet can be fastened loosely adjacent the inner leg and rump area of the worker. As shown in FIGS. 5 and 6, when a worker straddling an I-beam grips such beam with his legs, the sheet member is disposed between the legs and the beam. Also provided, as shown in FIG. 1, is a C-clamp which is used to secure the flexible sheet to the top flange of the I-beam so that it cannot slide on a sharply angled beam.

U.S. Pat. No. 5,048,640 issued to J. J. McConville et al. on Sep. 17, 1991, entitled "Work Platform Supported by Structural Beams," discloses a movable work platform arranged so as to be suspended from and roll between a pair of structural steel beams. The McConville et al. platform is indicated as being mostly used between large beams used in bridge construction, and is designed to take the place of a large amount of scaffolding otherwise needed to allow workers to perform required work between the beams.

U.S. Pat. No. 5,165,499 issued to M. Bell on Nov. 24, 1992, entitled "Anchor System for Use With Fall Prevention Safety Devices," discloses another strap for anchoring a worker to a structural beam. The Bell strap includes a ratchet-type fastening device which is secured around the circumference of a structural beam.

U.S. Pat. No. 5,607,029 issued to D. K. Beckham on Mar. 4, 1997, entitled "Safety Device," discloses another safety device comprised of an upright, elongated post (12), a lower jaw (13) which fits under the lower flange of a structural beam, and an adjustable upper jaw (14) which fits over the upper flange of a structural beam and is basically in the form of a C-channel. Beckham generally teaches another arrangement for connecting an apparatus to a steel beam or column.

U.S. Pat. No. 5,730,245 issued to J. Conway on Mar. 24, 1998, entitled "Safety Cable Deck Anchor," discloses an anchor system for worker safety cables which is designed to be slipped over and clamped to the upper flanges of two I-beams. The device is made of three main layers preferably all made of steel and welded or otherwise interconnected. The inner layer is slightly shorter than the outer layers so that a space is created large enough for the ends of the I-beam flanges to be fitted. Setscrews are then used to anchor the platform to the beams. Conway generally illustrates an anchor having a multi-layered plate arrangement such as used with your clamping system.

U.S. Pat. No. 6,053,279 issued to J. McKenna on Apr. 25, 2000, entitled "Structural Beam Safety Attachment," discloses another means for attaching a safety belt to a structural beam. The McKenna attachment is comprised of first and second components (11 and 12) connected together by a clamp (17). The main components each have a U-bend which fit over the sides of the I-beam flange, and the clamp is then used to bring the bends together so that the device is locked to the beam. The clamp is attached to a tether which is then attached to a worker in the usual manner.

U.S. Pat. No. 6,227,330 issued to M. A. Preusser et al. on May 8, 2001, entitled "Support Structure for Suspending a Work Surface Below a Girder," discloses platform which is suspended from the underside of a bridge. Note that the platform is secured to an I-beam flange or web by four clamp members (23). Preusser et al. generally teaches a suspended platform which is attachable to an I-beam by C-clamp, although structurally such platform is completely different from the present applicant's portable seat. U.S. Pat. No. 6,302,238 also issued to Preusser et al. is a continuation application of the '330 Preusser et al. patent.

While there have thus been work chairs for working under and around steel beams, including I-beams, and C-clamp or other type clamps to hold various working equipment including seats and safety devices and arrangements for use in working and attached to structural beams, no previous device, so far as is known to the present inventor, has provided the benefits in safety and convenience of the present inventor's working or welding seat arrangement. Not only is the present inventor's working seat more securely attached to the flanges of an I-beam where the welder can see that it is secure, but the seat of the invention has a construction and lightness that enables it to be easily transported by the welder from place to place where it can be used or is to be used.

SUMMARY OF THE INVENTION

A cantilevered working seat, designed particularly for structural steel welders, is mounted on one end of a light weight strong metal structural section with a seating surface constituting a first plate securely attached to one outer end and a flat plate, constituting a second friction plate, of substantial area securely attached to the other outer end of the metal structural section. A strong preferably wrought steel clamp is provided with its lower end mounted to or on the structural section below the inner end of the second plate. Such clamp is preferably in the form of a threaded clamp with an angle of contact adjustment means on its end. Such clamp provides initial clamping pressure on the top of a flange of an I-beam to which the seat is to be attached and also very importantly provides a fulcrum point toward the outer side or edge of the flange about which the structural member, when a welder's weight is placed upon the end attempts to rotate or imperceptibly rotates causing the other end of the structural member to be rotatably forced or driven upwardly so that the second friction plate is pressed intimately into contact with the lower beam flange preventing any chance of the seat structure slipping from the beam. A footrest for the welder's feet depends from the horizontal structural beam just beyond the edge of the flange and a safety connection is preferably mounted near or at the top of this to "tie off," or secure, the seat for safety.

It is necessary that the second plate have a fair amount of surface area particularly toward its outer end in order to obtain maximum clamping advantage and the first plate or seat surface should be a reasonable distance from the clamping end to gain good leverage of the second plate against the lower portion of the beam.

OBJECTS OF THE INVENTION

It is an object of the present invention to provide a device for facilitating access of a welder or the like to the lower portions of horizontal I-beams used in high-rise construction.

It is a further object of the present invention to provide a portable device which can be conveniently carried by a high worker which will securely clamp to the flanges of an I-beam and provide a platform from which an iron worker may work on the central or lower portions of the beam.

It is a still further object of the present invention to provide a working platform for high-rise construction workers adapted to be attachable to an I-beam by a clamping arrangement in which the security of attachment is increased by leverage provided by the weight of the worker.

It is a still further object of the invention to provide a leveraged clamping seat to accommodate a high-rise structural worker while working on the central and lower portions of a horizontal I-beam.

It is a still further object of the invention to provide an efficient clamping arrangement for clamping a high structural workers seat to the flanges of a substantially horizontal I-beam.

It is a still further object of the invention to provide a leverage assisted clamp arrangement for securing a high workers working seat to the lower flange of a horizontal I-beam.

It is a still further object of the invention to provide a light easily carryable clamp-on seat for use in high construction.

It is a still further object of the invention to provide a clamp-on seat for high workers on I-beams to clamp the seat to a flange of a horizontal I-beam and using an oversized friction plate at the clamping end which is brought into secure engagement with the I-beam by leverage provided by an extended arm supporting at the other end a seat for the user.

Still other objects, advantages, and features of the invention will become clear upon review of the following detailed description in conjunction with the appended drawings.

DETAILED DESCRIPTION OF THE PREFERRED EMBODIMENTS

Figure 1:
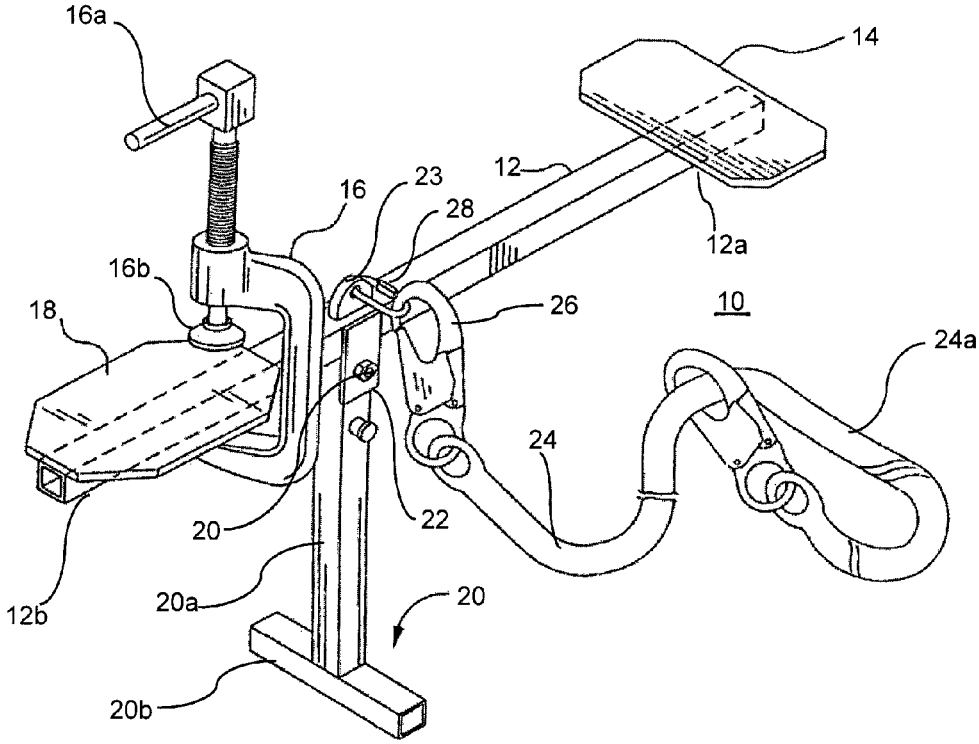
FIG. 1 is an isometric top front view of the welder's seat of the invention by itself.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention provides an improved welder's seat usable by iron workers not only for welding on the sides and bottom of horizontal structural steel beams, known as I-beams because of their cross-sectioned outline in the form of a large printed letter "I," but for other types of work on such beams or similar structural beams. Such I-beams are, as explained above, particularly stiff with respect to bending or flexing in any direction because of the relative width of both their flanges plus the width of their intermediate webs connecting the flanges when compared to their overall weight, which weight is dependent upon the actual volume of metal in the I-beam, and are widely used in the construction of large as well as small sturdy buildings and large bridges.

While it is relatively easy for an iron-worker or high worker to walk along the top of an I-beam even at great heights, because of the size and cross-sectioned shape, it is relatively difficult to gain access to the lower portions of such beams in high buildings and other structures particularly in the early stages of construction when little else has been erected except a basic framework of steel. Nevertheless, access is frequently needed for installing bolts between beams or for welding various beams together. For example, a series of smaller I-beams or other structural sections may be welded directly to the sides of the main I-beams on the outside of a building or at midpoints throughout a floor or one story of a building framework to support intermediate floors or serve as floor joists. In addition, other larger crossbeams may be welded to the main horizontal beams of a building structure or even more frequently small steel L-sections may be welded to the sides or even the bottom of the main beams, to which L-sections, or brackets, other intermediate beams or structural sections may be connected by bolts or rivets or again by welding. Welding, however, is the primary means by which suitable brackets can be attached to large beams for the attachment of other members. Welding upon the top of a beam is not much different from welding on a horizontal surface or floor, at least if one is accustomed to heights. However, welding of brackets or the like to the sides of beams such as I-beams can become fairly difficult because of the awkward position. The welder can either lie on the top of the beam and reach down or can stand or sit on some support provided along the side of the beam or can be lowered in a sling down the side or along side the beam at the point or location where welding is to be done. In general, the larger an I-beam the more difficult it may be to access the sides for welding. Earlier inventors such as Schaeffer and Mallog in U.S. Pat. Nos. 2,854,292 and 3,011,587 in the sixth and seventh decades of the last century provided chair or seat-type supports for use along side of large I-beams. While such arrangements were at least somewhat effective or at least workable, they were not wholly satisfactory, because they required, by and large, either the aid of several ironworkers to place in position or the use of a hoisting device of some sort to position such seat supports in place.

Recognizing the problems of the prior art devices and wishing to obviate such problems, the present inventor has designed a simple and effective welding chair that is both light and compact enough to be physically handled and carried by a single workman even in high places and which can be securely attached in place by a single high elevation worker entirely by him or herself and which, while supporting the weight of such worker, is unusually effectively and securely attached to an I-beam in a manner allowing easy and convenient access particularly to the sides of I-beams where the major number of high building welding operations occur.

The high work welding chair or seat of the invention has two major innovations. The first is the provision upon a light structural metal arm of a simple seat for a welder at one extreme end comprised of a first plate also formed of the light metal and referred to as the first plate plus the provision of a securing plate referred to as the second plate also of a light structural metal positioned at the other end of the structural member. This second plate is designed to be held flat against the lower surface of the lower flange of an I-beam. Such securing plate is designed to extend fairly deep or far back along the bottom of a lower flange of an I-beam to obtain a large amount of surface contact with such bottom surface. At the inside end of the securing plate there is provided a C-configuration screw clamp formed preferably of wrought steel or other strong tough metal with the bottom surface of the C-clamp being welded, braised or otherwise permanently attached to the lower surface of said structural section near the bottom of the second plate contact means. The end of the screw section is preferably provided with an adjustable or self-adjustable contact head and is very much smaller than the contact plate so that when it is severely screwed down it provides a secure surface contact with the upper surface of the I-beam flange, while the wide contact plate underneath is very intimately contacted with the undersurface of the I-beam forming a significant friction surface between the two. The adjustment member at the end of the screw member of the screw clamp will adapt to either the flat top surface of the lower flange of a fabricated I-beam or the slightly slanted top surface of the lower flange of a rolled I-beam and the combination of a large flat surface underneath the lower flange plus a small surface contact on the top of the flange positioned near the outer limits of the large contact plate, creates an effective fulcrum point on the outer portion of the flange, while the weight of the welder on the end of the structural arm creates an additional leveraged contact force between the contact plate and the surface of the flange which becomes even stronger towards the rear of the plate or the central portion of the beam, very effectively locking the welder's seat as a whole to the lower flange of the I-beam and at the same time providing the welder or other worker familiar with the combination clamping and holding action and recognizing how it operates a strong sense of security. A footrest is also provided dependent from the leverage arm to steady the welder during his work, plus in a preferred embodiment an attachment point for a safety tie off by means of a safety lanyard of the seat as a whole.

In FIG. 1 there is shown an isometric view from the top left of the welder's seat of the invention in which reference numeral 10 indicates the seat as a whole. A structural or leverage arm 12, in the case shown constructed of a square tubular section, has mounted upon the top on the outer end a more or less rectangular seat 14 with chamfered corners to eliminate any pointed sections which might catch on a welders clothing and also generally increase the attractiveness of the entire design of the welder's seat of the invention. The corners may be rounded rather than merely chamfered if desired. Such seat is welded or otherwise secured to the structural leverage beam 12 and is of a size to reasonably comfortably and effectively provide a seating or support surface for a welder or other user of the working seat of the invention. At the other end of structural section or leverage beam 12 there is provided a friction plate 18 essentially generally similar in size to the seat 14 and also securely attached to the top of the leverage arm by some appropriate means. As shown, the friction plate may be turned, or positioned, lengthwise on the leverage arm and extends at least several inches along the beam. The leverage arm 12 should extend right to the end of the friction plate as it serves as a reinforcement for such plate. However, the friction plate should not be longer than the width of the flanges on the smallest I-beams with which the welder's seat is expected to be used. A length of 4 to 12 inches will usually be satisfactory for the friction plate with a preferred length of 6 to 10 inches and a width of 5 to 7 inches. This allows a fair amount of flexibility with respect to the I-beams and flanges of the I-beams the seat is used with. Of course, if the seat is only to be used with or attached to the lower flange of an I-beam it is possible for the second or friction plate to be longer since it can then extend farther across the beam or the midpoint of the beam. An intermediate size for the friction plate will generally make the seat as a whole more readily adaptable to a variety of beam sizes. The seat will usually not be attached to smaller beams, however, because the sides of such beams are readily accessible from the top.

Near the inner end of the friction plate 18 there is mounted a screw clamp preferably in the form of a wrought metal clamp 16 with its lower jaw welded or otherwise securely attached to the bottom of the leverage arm 12 under the inner end of the friction plate 18, or more particularly under the portion of the friction plate extending toward the seat 14. The C-clamp 16 is oriented at about a 45 degree angle with respect to the length of the leverage arm 12 and the clamping surface positioned about one quarter of the length of the plate from the inner end so that in clamping the arm to the flange of an I-beam the ends of the jaws of the clamp will bracket or extend over the outer edge of the I-beam sufficiently away from the edge so that a good clamping grip can be obtained. The top of the screw threaded member of the clamp 16 is provided with a grip member 16(*a*) and the contact end of the screw portion of the clamp is provided with a conventional pivot fitting 16(*b*) which enables the lower surface of the screw clamp member to adjust to the exact angle or slant of the top of the lower flange of the I-beam. It should be noted that the length of the friction plate is not limited by the depth or width of the top of the lower flange of the I-beam, because the lower surface is equivalent to the width of two entire flanges. However, while it is beneficial to have as much contact area as possible between the friction plate and the lower surface of the lower flange of the I-beam, it is best not to have the friction plate 18 plus the end of the leverage arm 12 too long, because the longer this end of arm is the less the differential leverage factor between the end of the lever 12 extending past the leverage or fulcrum point of the lever with respect to the length of the entire leverage arm 12. The outer length of the lever arm 12 from the fulcrum point to the seat 14 is limited by the size of the welder who must be able to reach the side of the flange of the I-beam usually to accomplish his welding. Thus, while it is usually advantageous to have as large a friction plate 18 as possible, it is even more important to have the relative lengths of the outer leverage arm 12(*a*) under the seat 14 and extending to the pivot point and the inner leverage arm 12(*b*) under the friction plate 18 up to the pivot point represented by the clamp 16 to provide an effective leverage to force the friction plate against the bottom of the flange as tightly as possible. A leverage differential of about three to eight has been found to be very effective. However, this may vary from ratios of 1 to 4 to 1 to 10. Thus, the longer the portion of the arm from the fulcrum point to the end of the lever on the friction plate end the less likely that a tight clamping contact will be attained, although the overall area of clamping surface contacting the flange may continue to increase. The actual security of clamping of the seat to the beam flange will be the combined function of the size of the friction plate 18 particularly toward the outer end and the differential of the leverage arm 12 between sections 12(*a*) and 12(*b*) of such arm. It is preferred to have the clamp operate against the friction plate from about one eighth to one third of the distance from the inner end of such plate with a preference for a position relatively close to the end.

The footrest 20 of the welder's seat 10 is comprised of a vertical support rod formed also preferably from a section of hollow tubing 20(*a*) pivotally secured to the leverage arm or beam 12 by opposed brackets 22 attached to the leverage arm 12 near the friction plate 18 and clamp 16. A cross piece 20(*b*) is provided for actual placement of the welder's feet. When not in use the footrest 20 can be pivoted on pintle 20(*c*) passing through the brackets 22 and vertical support rod 20(*a*) to a position parallel with the leverage beam 12. Such pintle 20(*c*) is shown as being a bolt secured in aligned openings in the brackets 22 and in the vertical support rod 20(*a*). Preferably directly over the end of the footrest support is a further half round bracket 23 preferably securely welded to the top of leverage beam or arm 12 which may serve as an attachment point for a safety lanyard 24 which may by suitable clips 26 and a ring 28 be secured to the bracket 23. The lanyard 24 serves to tie off, or attach, the welders seat to a suitable safety line to which the welder will also be tied off, or attached, by a personal safety line and usually a safety belt or harness to which the line is attached. It is preferable for the safety line securing the seat as a whole not to be attached to the welder, but to be separately tied off to the main safety line erected on every job. As indicated, the safety line 24 used to secure or tie off the welder's seat can be used in between tying off the seat as means to carry the seat, usually over the shoulder of the welder, from one job position to another.

Since the welder's seat of the invention is constructed of light but strong metals such as aluminum or aluminum-magnesium alloy, except for the preferably wrought steel clamps 16, it is significantly lighter than other type welding seats and the like and can be easily carried by the welder as a personal seat. Basically the major portions of the seat such as the elongated support and leverage arm, the actual seat plate, the friction plate and the footrest members are formed of light nonferrous metals such as aluminum or aluminum magnesium alloy, while the clamp structure, which is critical in supporting the seat structure, is of ferrous metal such as wrought or forged steel or the equivalent. In effecting carrying or transport of the seat structure the temporary loop 24*a* shown at the end of the lanyard 24 in the figures may be passed over the seat 14, the loop 24*a* pulled smaller and the intermediate portion of the lanyard 24 looped over the body of the welder to suspend the seat to the welder's person.

Figure 2:
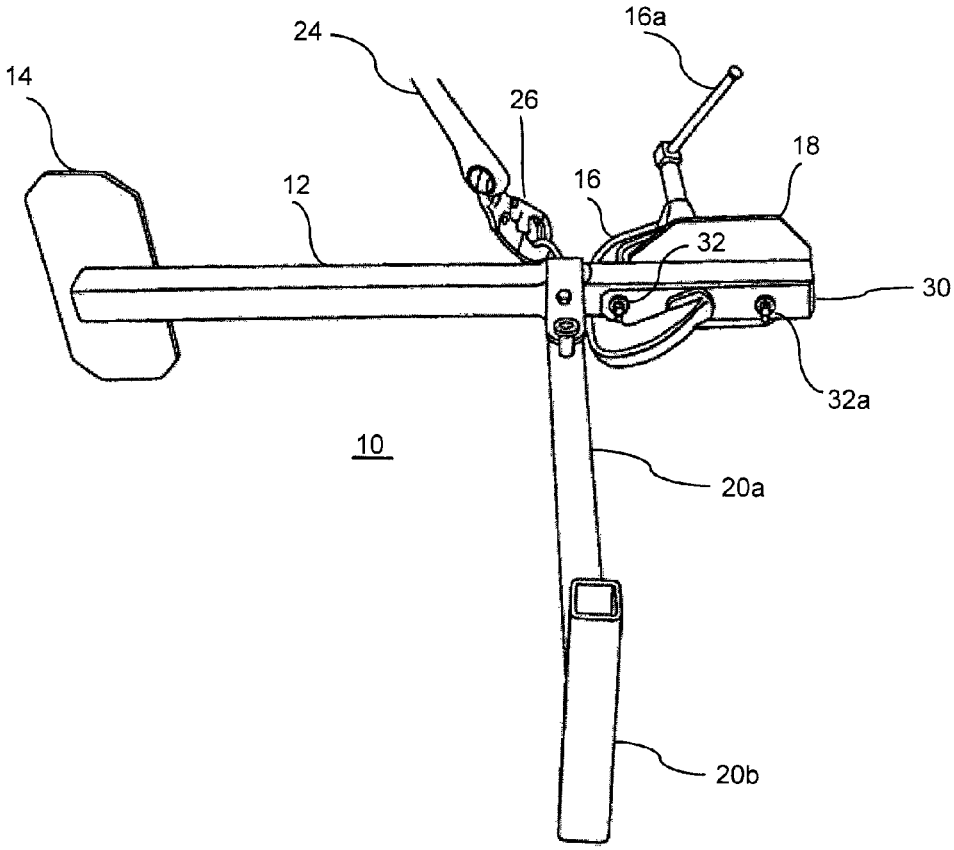
FIG. 2 is an isometric bottom right view of the welder's seat.
Figure 3:
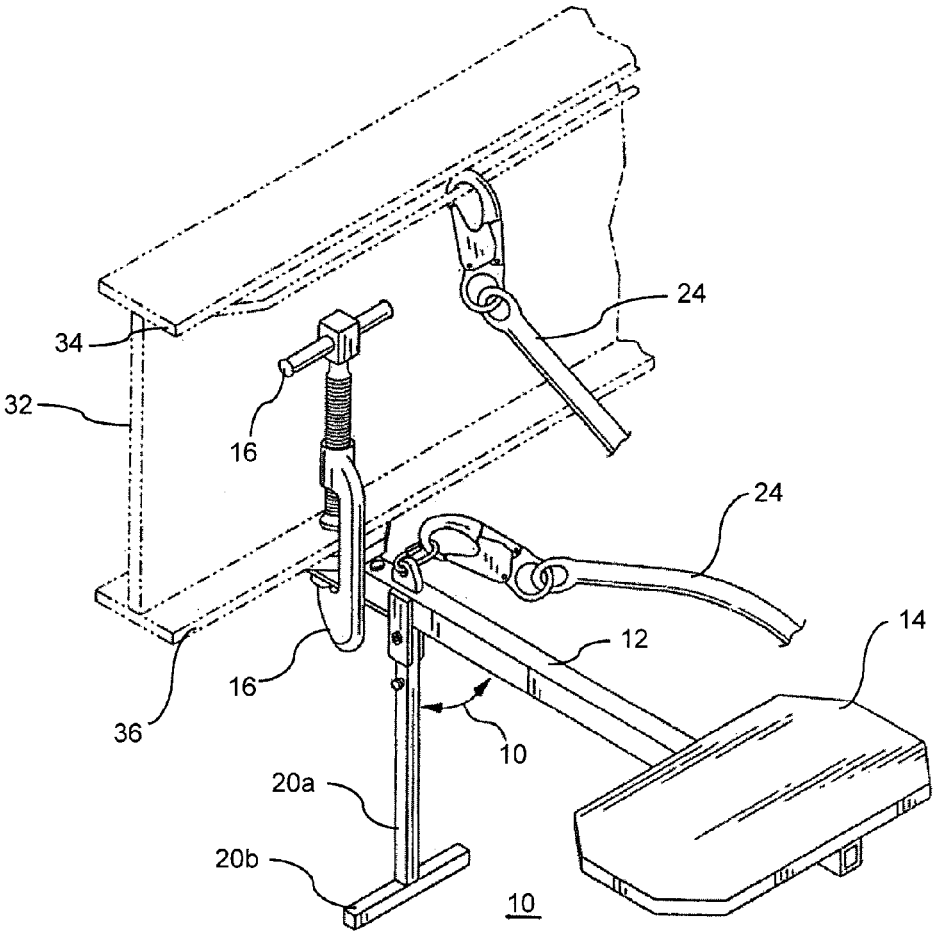
FIG. 3 is an isometric view of the welder's seat of the invention clamped or mounted in place on an I-beam and tied off to a safety line running parallel to the beam.

FIG. 2 shows in a somewhat reduced scale a bottom view from the right side of the welder's seat of the invention and shows a further preferred strengthening of bearing plate 30 secured by fastenings 32 to the leverage arm 12 to which the lower jaw of the clamp member 16 is attached. Plate 30 if used may considerably strengthen the section of the leverage arm 12 to which the clamp 16 is attached. FIG. 3 shows the welder's seat of the invention attached to a large I-beam in working position.

In use of the welder's seat of the invention the welder may carry his personal seat to the job or may be assigned by his employer with a temporary seat for his use. The welder will then take the seat with him slung on his back or over his or her shoulder or otherwise carried. The seat, which may desirably weigh around 45 or 46 pounds, will be taken up to the elevated job site and carried by the welder or other workman out on the I-beam upon which welding or other work is to be carried out. When the point is reached where welding or the like is to be effected on the side of the beam or otherwise, the welder will unsling the seat and leaning down over the side of the beam may place the friction plate 18 under the lower flange 36 of the beam as shown in FIG. 3 with the screw portion of the clamp over the top of the flange 36 away from, but relatively close to the edge of the beam 32. The welder will then tighten the screw end 16*b* down upon the flange until it seems secure. Then first making certain that he or she is tied off to a safety line, cable or rod 30 shown as extending from one end of the beam 32 to the other, see FIG. 3, or across several beams just below the upper flange 34 thereof the welder will step down usually first on the lower beam flange and make certain the clamp is tightened against the flange with the friction plate 18 of the welders seat 10 under the lower flange 36 of the I-beam 32 and with the clamp 16 positioned close to the edge of the flange of the I-beam. If the clamp is not secure, the welder will tighten the screw portion of clamp 16 by turning of the handle 16(*c*) drawing the friction plate tightly against the bottom of the lower flange and incidentally establishing a fulcrum or leverage point through the clamp, the friction plate and the leverage arm 12. At this juncture the welder may step down on the footrest 20*a* placing his or her feet on the crosspiece 20*b* and sit down on the seat 14. As soon as the welder's weight is placed upon the seat 14, such weight applied at the outer end of the leverage arm from the fulcrum provided by the clamp 16 further presses or causes the short end in particular of the leverage arm 12 upon which friction plate 18 is mounted to be pressed upwardly tightly pressing the friction plate upwardly against the bottom of the I-beam 32 making it substantially impossible for the seat clamp to be pulled backward off the flange. Thus, the leverage factor plus the large surface area of the friction plate with the lower portion of the flange make it well nigh impossible for the seat as a whole to slip from its clamped position, at least until the weight of the welder is removed form the seat. As will be evident, the I-beam shown in FIG. 2 is a fairly small but typical I-beam and is of the fabricated variety, since the lower flange is essentially in the form of a long rectangular plate. The outer end of the friction plate will, furthermore, extend across the entire bottom of the flange and, if it extends somewhat beyond, some clamping pressure will be lost because of a lesser overall leverage movement. However, the seat will still be clamped tightly and effectively to the flange. When the welder's seat, furthermore, in the form of the leverage arm and friction plate is engaged with a larger I-beam, it still fits perfectly against the lower flange of the beam and is clamped very securely. Since the bottom of an I-beam of either the fabricated kind or of a rolled type of I-beam is essentially flat except for a possible roll parting line in the center, plus a possible small chamfer, the flat friction plate intermits with such beam bottom very effectively. The seat can also be attached, if desired, to the top flange of an I-beam of the fabricated variety. However, since in a rolled I-beam the inside surfaces of the flanges are usually somewhat slanted the present seat of the invention is not well adapted for clamping into the top flanges of beams of this type of beam because the orientation of the bottom of an upper flange is somewhat slanted upwardly which would tend to slant the leverage arm 12 and the seat 14 somewhat upwardly when secured to the flange, since it is the orientation of the friction plate which determines the orientation of the entire seat apparatus. There is little need to have a seat extending outwardly at the height of the upper flange in most cases, however, since adequate access to the top of the beam is available, this being the portion that workers normally traverse in any event. However, in a modification of the seat of the invention the leverage arm could be constructed with a step or jag along its length bringing the seat on one end lower than the friction plate on the other end. The same leverage would be obtained to press the friction plate into the flange as long as the total ratio of length of the leverage arm on each side of the fulcrum point 17 is maintained the same in absolute terms measured outwardly in a common plane.

Other variations of the construction of the seat apparatus are: (1) that the seating plate 14 may be contoured to better fit the usual posterior conformation of the human body. However, this is usually not necessary as seating on the seating plate is for relatively short periods at any one time, since welding is usually fairly quickly completed at any one location and the seat of the invention will be moved frequently. In addition, the contour for one person may well not be the best for another. (2) Since different workers are of different sizes, particularly with respect to arm length and leg length, it may be advantageous to provide a two piece leverage arm one section of which telescopes into the other so that the length of the leverage beam can be varied to the size of the worker with the telescoping length lockable together by appropriate setscrews. While it is advantageous to have the seat as far out on the leverage arm as possible in order to obtain the greatest possible amount distance between the welder and the fulcrum point 17, in order to press the friction plate 18 into the bottom of the lower flange with as much force as possible, the welder cannot be spaced so far from the side of the beam that his arms cannot reach the working area or comfortably work in the working area. (3) The friction plate can since it is particularly forcefully pressed against the under portion of the flange at the extreme end be made larger at such point. For example, it could be formed in a triangular shape or configuration with the greatest lateral dimensions provided at the extreme end. This may be desirable or practical only where the seat apparatus of the invention is to be used principally with a particular sized beam, since if the beam were relatively narrow the widest portion of the friction plate might then extend beyond the flange, decreasing the friction area engaged more than desirable. It has been found consequently that the rectangular shape shown is in most cases the most practical configuration. (4) It will also be understood that the particular clamp design could be varied as long as its lower portion or anvil portion is on the lower portion of the leverage arm preferably under end of the friction plate, although it could be slightly beyond or inside of the friction plate. It is preferable for there to be a direct connection between the jaws of the clamp, however, and if the friction plate is not partially interposed between the jaws of the clamp, a separate solid member should be provided to effect such relationship, i.e. provide direct clamping pressure. The clamping device could also be in the form of a quick clamp of some sort. However, it has been found that a simple screw-type C-clamp is very effective and usually preferred by the user, since it provides good feel for such user regarding when a maximum clamping action is attained, alleviating any qualms the user of the seat of the invention may have concerning the security of the seat. As explained above, it is highly desirable that the end of the screw member of the clamp be provided with a self-adjustment means to allow it to adjust to the inclination of the surface. It would also be possible to use a fairly sharp end on the screw member which would tend to bite into the metal, but would also then be more likely to break off and would require more rotation to back off when it is desired to remove the seat and place it in another position.

As will be recognized from the above, the seat of the invention is particularly secure in use as the result of the use of an oversized friction plate leveraged into the lower portion of the flange of an I-beam upon which the seat is mounted as the result of a clamp serving as an initial clamping means and upon the application of significant weight upon the far end of the leverage bar serving as a fulcrum or leverage point about which the leverage bar rotates bringing the friction plate into secure frictional contact with the underside of the flange of the I-beam upon which the seat of the invention is secured.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A working seat for safe and secure temporary support of a construction worker by providing secure temporary attachment to a flange of an at least temporarily erected structural beam including but not limited to structural beams formed by a rolling operation comprising:

(a) an elongated supporting and leverage arm adapted to be clamped to a structural beam so as to extend generally transversely of said beam to support a construction worker in a working position transversely of said beam and having established first and second ends the first of which is adapted for attachment by clamping to the beam and the second of which is adapted to support a structured worker;

(b) a first plate secured by welding to the elongated supporting and leverage arm at a first end of the said elongated supporting and leverage arm and adapted for temporary intimate frictional contact with the lower surface of a beam flange;

(c) a second plate secured by welding to the elongated supporting and leverage arm at a second end of the arm removed from the first end said second plate being adapted to serve as a temporary working seat for a construction worker;

(d) an adjustable clamping means adjacent the first end of the first plate, the clamping surface of which adjustable clamping means is secured by welding to the elongated supporting and leverage arm and is restricted in size when compared to the surface area of the first plate and adjustable in clamp spacing with respect to the first plate which serves as a friction plate and is adapted to clamp the first plate and working seat structure as well as the intermediate supporting and leverage arm as a whole to a flange of a structural beam, and wherein the relative size of first plate and the position of the clamping means with respect to the first plate and the beam flange is effective to convert weight force applied to the second plate into leveraged pressure of the first plate against the lower surface of the beam flange compensating against any tendency for the seat to slip from its temporary attachment to the beam flange in proportion to the weight of a construction worker making use of the seat as a working seat;

(e) a foot support attached to the elongated supporting and leverage arm extending downwardly from the side opposite which the first and second plates are secured and spaced further from the second plate than the first plate.

2. A working seat in accordance with claim 1 wherein the foot support is comprised of a supporting member extending away from the elongated supporting and leverage arm with a cross piece at the lower end adapted for support of the user's feet.

3. A working seat in accordance with claim 2 wherein the foot support is pivoted with respect to the elongated supporting and leverage arm to allow pivoting to a carrying position.

4. A working seat in accordance with claim 1 in which the clamping means is in the form of a "C" clamp provided with a rotary tightening means.

5. A working seat in accordance with claim 4 wherein the rotary tightening means comprises a threaded screw member mounted for rotary screw action in the upper end of the C-clamp arranged for upward and downward movement.

6. A working seat in accordance with claim 5 wherein the screw threaded member is provided with an adjustable contact end to enable it to conform to the angle of the top of a beam flange.

7. A working seat in accordance with claim 1 additionally comprising:

(f) a lanyard attached to the working seat for attachment to a safety tie off line attached to a beam upon which the seat is attached.

8. A working seat in accordance with claim 7 in which the lanyard is equipped with clips at both ends adapted for securing to an attachment fitting on the working seat in the vicinity of the footrest and to a tie off safety line and is of a length such that the clip used for tying off can be doubled back and attached to the lanyard itself to form a loop which can be passed over the second plate leaving a length of lanyard forming a sling by which a worker can carry the working seat between uses slung over such worker's body and supported on the worker's shoulder.

9. A working seat in accordance with claim 6 in which the clamp is formed of worked ferrous metal for strength and toughness.

10. A working seat in accordance with claim 9 wherein the elongated supporting and leverage arm and at least some of the components of the footrest are formed from rectangular tubular metal sections for lightness and strength.

11. A working seat in accordance with claim 5 wherein the clamp is attached to the elongated support and leverage arm in a position partly overlapping the first friction plate, but closer to the inner end of such plate.

12. A working seat in accordance with claim 11 in which the clamp position is from one eighth to one third of the length of the friction plate from the inner end.

* * * * *